United States Patent [19]

Goldstein

[11] Patent Number: 4,989,282

[45] Date of Patent: Feb. 5, 1991

[54] EXTENDABLE SLEEPING BAG

[76] Inventor: Mark Goldstein, 2696 Troy Rd., Schenectady, N.Y. 12309

[21] Appl. No.: 525,350

[22] Filed: May 17, 1990

[51] Int. Cl.[5] ..... A47G 9/06

[52] U.S. Cl. ..... 5/413; 2/69.5

[58] Field of Search ..... 5/413, 416, 494; 2/69.5, 84

[56] References Cited

U.S. PATENT DOCUMENTS

| | | | |
|---|---|---|---|
| 1,919,154 | 7/1933 | Astrove | 5/413 X |
| 2,338,226 | 1/1944 | Bauer | 5/413 X |
| 2,372,110 | 3/1945 | Noone . | |
| 2,537,537 | 1/1951 | Ljungberg | 5/413 X |
| 2,670,470 | 3/1954 | Manheim et al. . | |
| 2,717,395 | 9/1955 | Holshouser . | |
| 2,730,721 | 1/1956 | Van Veen | 5/413 X |
| 2,757,390 | 8/1956 | Miller | 5/416 |
| 3,555,567 | 1/1971 | Owen . | |
| 3,831,206 | 8/1974 | Geary | 5/413 |
| 3,959,834 | 6/1976 | Hunt | 2/69.5 |
| 3,965,487 | 6/1976 | Mazur . | |
| 4,688,282 | 8/1987 | Jeffries . | |
| 4,703,521 | 11/1987 | Asher et al. . | |

*Primary Examiner*—Michael F. Trettel

*Attorney, Agent, or Firm*—Schmeiser, Morelle & Watts

[57] ABSTRACT

The instant invention is a mummy-type sleeping bag that includes additional component sections that allow the bag to be extended to fit a growing child. The bag includes a basic body section that has a top slot designed to fit around a child's head. To accommodate a larger child, a removable panel is placed over the slot and a hood section is added to the top of the basic sleeping bag body.

16 Claims, 2 Drawing Sheets

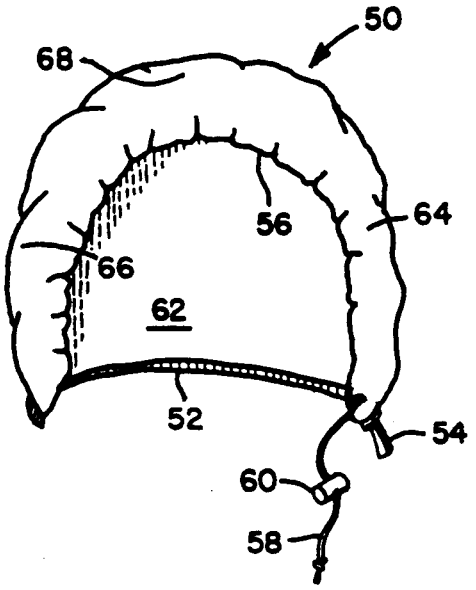
FIG. 3
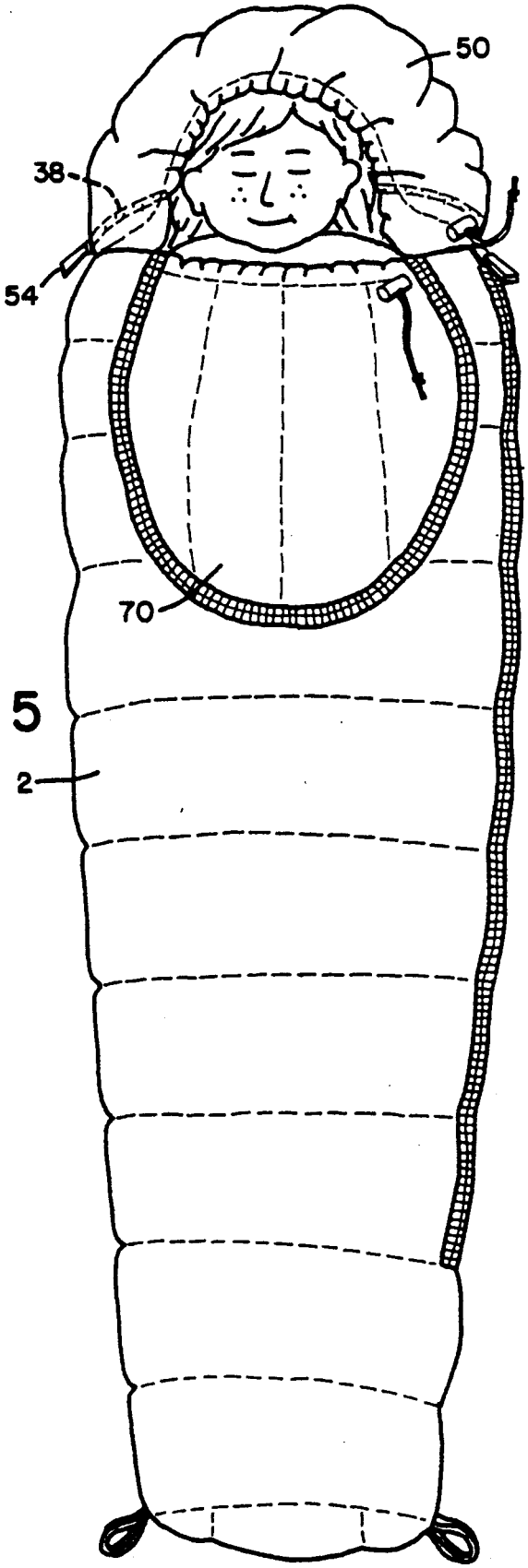
FIG. 5
FIG. 4
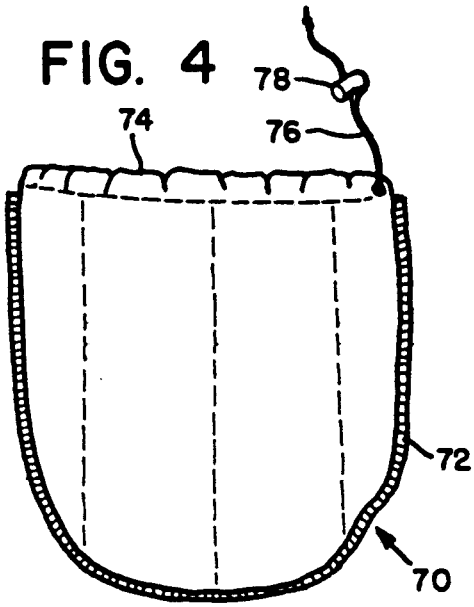

EXTENDABLE SLEEPING BAG

FIELD OF THE INVENTION

The invention is in the field of portable bedding units. More particularly, the invention is in the field of component sleeping bags.

BACKGROUND OF THE INVENTION

Sleeping bags originally were in the form of a blanket that had two side edges sewn together. As sleeping bag technology advanced, the wool blanket material commonly used became replaced by materials having a higher insulating value and lower weight. The improved sleeping bags were formed by placing an insulating material between two layers of a durable retaining material. Down was, and still is, favored for use as the insulating material in sleeping bags. There are presently a number of synthetic insulating materials that are also used such as HOLLOFILL, FIBERFILL THINSULATE and polyester batting. Common retaining materials are cotton, taffeta and ripstop nylon.

As sleeping bag material technology improved, the design of the bag was also improved. Sleeping bags were originally rectangular in shape. It was later learned that tapering the bottom end of the bag improved the bag's ability to keep the user's feet warm. By tapering the bag, the amount of contained dead air space is minimized. This led to a large variety of tapered bags. However, the design still included a large top opening that allowed a significant amount of heat to escape.

The next improvement was a modification in the top of the bag. The mummy style of bag was adopted and its use greatly alleviated the noted heat loss problem. In a mummy bag, the bag closely encases the entire body of the user save for a small opening above the user's face. This type of bag was found to be highly efficient due to both the minimal size of the opening and the bag's close fitting nature. However, inherent in the design of the mummy bag is a low degree of adaptability to fit different length users.

The size of a mummy-type bag must be closely matched to the size of the user. If the bag is overly long, an air space is created below the user's feet. This greatly reduces the bag's efficiency and may lead to insufficient heating of the user's lower extremities. For a fully grown adult, a properly sized bag can be chosen and this particular problem is minimized. For a growing child however, this limitation of the mummy-type bag is a significant problem.

Children have traditionally been relegated to using rectangular bags. These bags, while low in efficiency, do accommodate a growing child since they are not close fitting. Children's bags are typically four to five feet long and are capable of fitting a child of toddler age through early teen-age. Due to the child's rapid growth, use of a mummy-type bag for the child would require the purchase of a longer bag almost yearly. Therefore, most parents opt for a traditional, less efficient rectangular bag for their child until the child's growth slows.

SUMMARY OF THE INVENTION

The invention is a mummy-type bag that can be modified to allow its use by children of different lengths. The bag comprises a basic bag portion and two component portions. Initially, a small child would use solely the basic bag portion. Once the child grew a certain amount, the two component sections would be added to the basic bag and thereby increase the sleeping bag's length and its ability to accommodate the longer child.

The basic bag portion is substantially rectangular in shape and slightly tapers inwardly from its top to bottom. The upper side of the basic bag includes a slot shaped aperture in its top portion. When the user is within the bag, the user's body from the neck down is completely covered by the body of the bag. However, the user's head fits within the slot thereby leaving the top of the head and face exposed to the environment. A top portion of the bottom side of the bag includes a drawstring for gathering the top of the bag. Once the user is within the bag, the drawstring can be tightened and this causes the top portion of the bag to gather about the top of the user's head. Once fully gathered, the only opening into the bag is via the slot. In this configuration, the bag is both functionally and in appearance, identical to a common mummy-type of sleeping bag.

Once the child grows and the child's head no longer fits within the slot, the two additional component portions are fastened onto the basic bag. One of these portions is a panel member which completely covers the above mentioned slot-like opening. The other portion is a hood member that fastens onto the top edge of the bag. Once these portions are added, the bag resembles a mummy-type bag and functions in the same manner. The taller child can get into the now extended bag in the normal manner and his or her head would be situated within the added hood portion of the bag. The add on portions generally extend the bag approximately twelve to twenty-four inches depending on the size of the hood member.

Therefore, the primary object of the invention is to provide a mummy-type of sleeping bag that can be modified in length to accommodate long term use by growing children. This is accomplished by adding component elements that are both low in cost and low in weight. Furthermore, a stuff bag designed for the sleeping bag can easily retain both the basic bag and the additional component portions and thereby provide an easily transportable unit.

BRIEF DESCRIPTION OF THE DRAWINGS

FIG. 3 is a front view of a hood member.

FIG. 4 is a front view of a panel member.

FIG. 5 is a front view of a bag incorporating both the panel and hood members.

DETAILED DESCRIPTION OF THE DRAWINGS

The instant invention is a mummy-type sleeping bag that can be expanded to accommodate the growth of a child.

Figure 1:
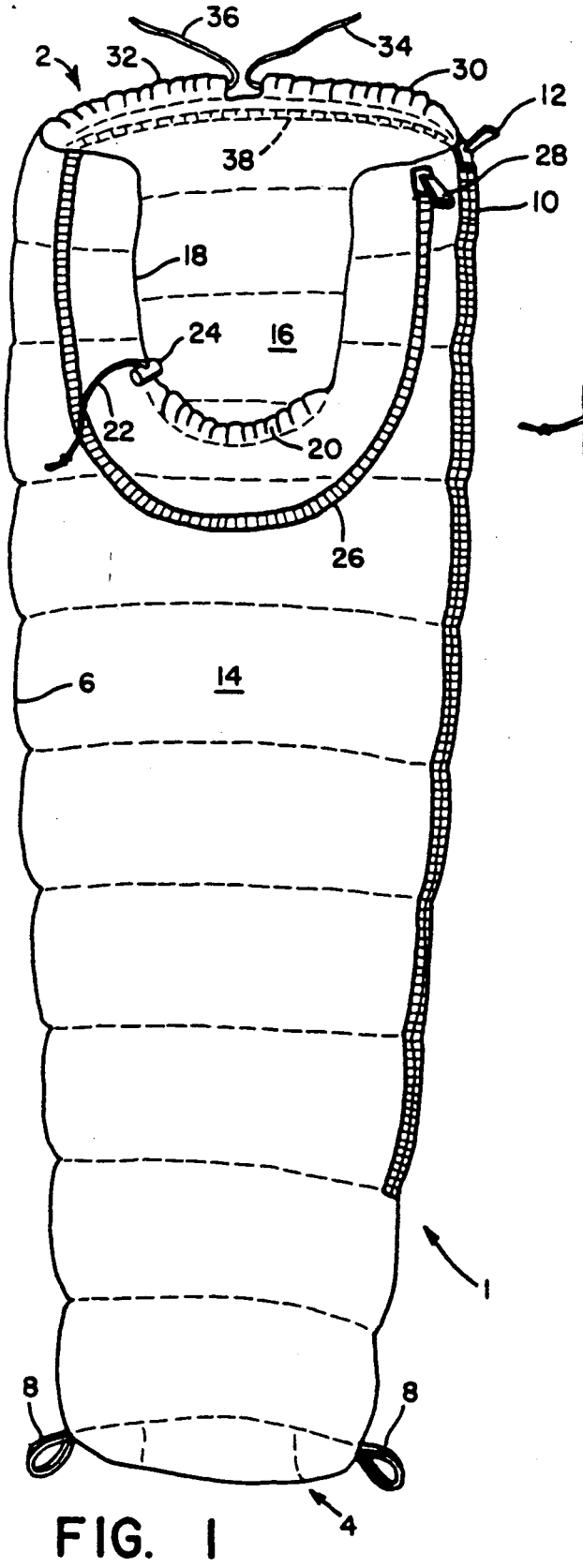
FIG. 1 is a front view of the invention in its initial state.

FIG. 1 shows the basic bag 1 in its initial state. The bag is basically rectangular in shape and slightly inwardly tapers from the open top 2 to the closed bottom 4. The bag comprises a tubular body 6 that is made from an insulating material. Extending from the bottom end are a pair of ties 8 that can be used to either retain the bag in a rolled up form or to hang the bag from a hook or similar object.

At the side of the bag is located a main zipper 10 which includes a toggle 12. The zipper is attached to an edge portion of both the front and rear sides of the body (14 and 16 respectively). The main zipper is used to open the bag and is similar to the side zipper used on conventional rectangular sleeping bags.

Located on the front side 14 of the body in its top portion is a 'u'-shaped slot 18 that is preferably at least eight inches long and six inches wide. At the base of the slot is a gather section 20 which houses a drawstring 22. Located on the drawstring is a moveable fastener 24 which is used to manually stop the movement of the drawstring once it is pulled from the gather. Pulling on the end of the drawstring causes a directly proportional reduction in the length of the gather section. It should be noted that the top edge of the front side of the bag lies below the top edge of the bag's rear side (i.e.—the back side of the bag is longer than the front side).

Located proximate the periphery of the slot is a zipper half 26. The zipper includes a toggle member 28. The complementary half of the zipper is located on the panel member which will be described shortly. Located on a top portion of the rear side 16 of the body is a pair of gather sections 30 and 32. Extending from each section is a drawstring 34 and 36. Pulling on the exposed ends of the drawstrings will cause a proportional reduction of the length of the associated gather sections. On the outer surface of the back side of the bag below the gather sections is a zipper half 38 (shown in phantom). The complementary half of this zipper is located on the base of the hood member which will also be described shortly.

Figure 2:
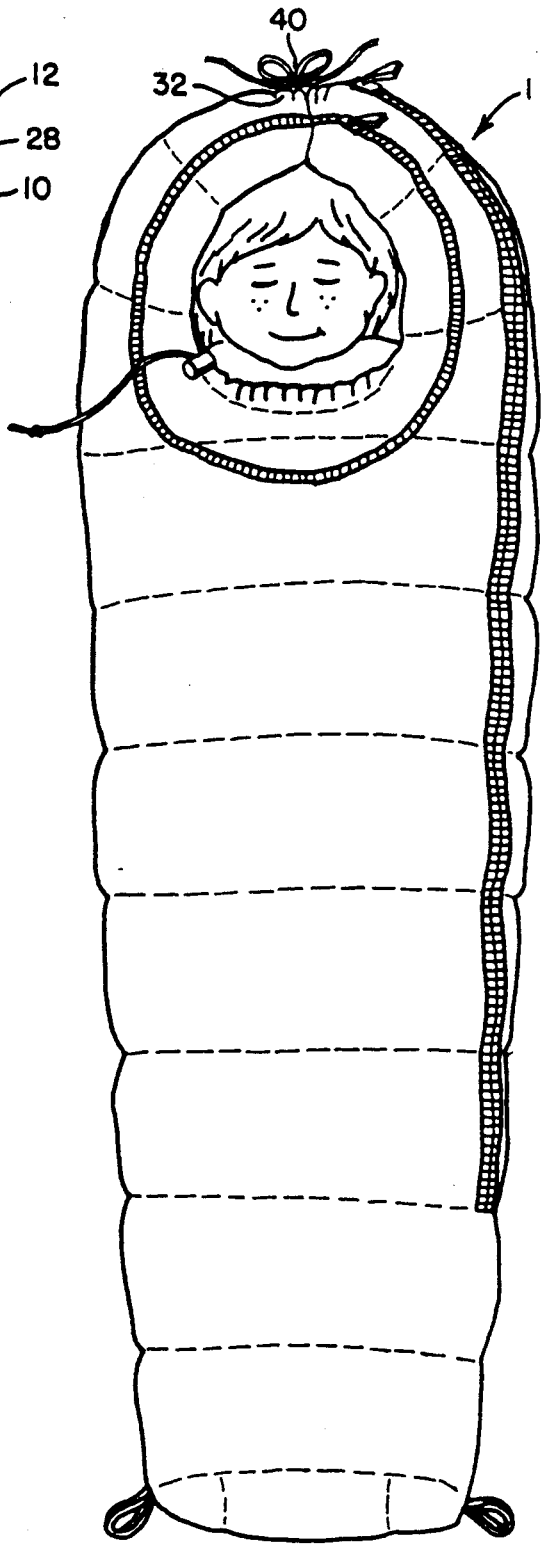
FIG. 2 is a front view of the invention showing the top of the bag gathered.

FIG. 2 shows the basic bag 1 in its mummy configuration housing a child. In this position, the top of the bag has been closed around the child's head by drawing together the top gather sections 30 and 32. This was accomplished by pulling tight the drawstrings 34 and 36 and tying them together in a knot 40. The slot shaped opening is now substantially circular in shape and provides the only opening into the interior of the bag. The gather 20 has also been tightened to snugly fit the opening to the child's head.

The normal method of use in cold weather would entail the child or a parent of the child tying the drawstrings together as shown in FIG. 2. Zipper 10 would be opened to allow the child to enter the bag. Once the child is inside the bag, the zipper would be closed. To get out of the bag, the child would reach an arm out of the opening and pull the zipper downwardly to open it.

FIG. 3 shows a hood member 50 which can be attached to the body of the basic bag. The hood member includes a zipper half 52 that has a toggle 54. Zipper 38, located on the body of the bag, forms the complementary half of this zipper. The entire front edge of the hood has a gather section 56 which borders the hood's front opening. Within the gather is a drawstring 58 that includes an end portion that is exterior to the gather. Located on the exterior portion of the drawstring is a movable fastener 60 which is used to lock a user determined length of the drawstring exterior to the gather. Withdrawing of the drawstring from the gather functions to reduce the size of the opening framed by the gather. The hood includes a back portion 62, sides 64, 66 and a top portion 68. The hood member is sized to envelop the back and sides of a child's head. Preferably, the hood is made from an insulating material similar to the material used for the basic bag.

FIG. 4 shows a front view of a panel member 70. The panel member has a shape which allows it to completely cover the 'U'-shaped slot 18 of the basic bag. A zipper half 72 is located on the panel's bottom and side periphery. The zipper half is complementary to zipper half 26 located on the body of the basic bag and which surrounds the slot-like opening. The top edge of the panel includes a gather 74 which inwardly receives a drawstring 76. At the end of the drawstring is a moveable fastener 78 which performs the same function as fasteners 24 and 60. The panel member is preferably made from the same insulating material as used for the basic bag.

FIG. 5 shows the basic bag with both the panel and hood members attached. The zipper 38 which attaches the hood member to the basic bag is again shown in phantom. A child is shown resting within the bag. In this view, both the hood gather 56 and panel gather 74 have been snugged about the child's face by an appropriate drawing out and locking of the drawstrings 58 and 76 respectively. The remaining opening comfortably fits the child's face yet is large enough to allow the child to reach out of the opening with an arm to both adjust the drawstring, and to open or close the zipper.

The hood and panel members are each about 18 inches in length. By their addition to the basic bag, the extended sleeping bag is made about 18 inches longer than the basic bag. In this way, the extended bag can comfortably fit a child that is up to 18 inches longer than could comfortably fit within the basic bag.

In practice, the basic bag and its two component members are sold as a complete unit. A stuff bag (not shown) is also provided and is used to house the bag. When a child is young, both the hood and panel members are removed from the basic bag and stored in the stuff bag. The young child would be able to use the basic bag for a certain amount of time such as one or two years. Once the child has outgrown the basic bag, the hood and panel members are attached to the basic bag and thereby allow the bag to comfortably fit the now larger child. The extended bag could then be used by the child for another period of time such as one or two years. Therefore, the bag could be used by a child for a large number of years and in the process, provide the child with the efficiencies and comfort associated with the mummy style of sleeping bag.

One additional advantage provided by the instant invention is its improved ventilation capacity compared to traditional mummy-type sleeping bags. A mummy bag will commonly have the main zipper located in the center of the top side of the bag. Ventilation is provided by opening or closing of the zipper and in this way the bag is adapted to different ambient temperatures. However, since the zipper is located in the center of the bag, it can be twisted by the user's movements and inadvertantly opened. In the instant invention, locating the main zipper 10 on the side of the bag provides improved control of the ventilation and also, the zipper is less prone to twisting and inadvertantly opening.

The embodiment disclosed herein has been discussed for the purpose of familiarizing the reader with the novel aspects of the invention. Although a preferred embodiment of the invention has been shown and described, many changes, modifications and substitutions may be made bY one having ordinary skill in the art without necessarily departing from the spirit and scope of the invention.

I claim:

1. A sleeping bag comprising:

a tube like body of insulating material having a closed bottom end, an open top end, a front side and a back side, said front side including an opening proximate the top end sized to expose substantially an entire face of a user;

a first connector means located on a top end of said back side of said body;

a hood means comprising a slot shaped front opening and a second connector means at a bottom end of said hood means, said second connector means for connecting said hood means to the first connector means whereby attaching said hood means to said body extends the length of said back side of said body;

a third connector means located on said body adjacent said front side opening; and a panel member including a fourth connector means proximate a peripheral edge of said panel member for attaching said panel member to the third connector means whereby said panel member can be attached to said front side of said body to thereby close said front side opening.

2. The bag of claim 1 wherein said opening is slot shaped.

3. The bag of claim 2 wherein said opening is at least eight inches long and six inches wide.

4. The bag of claim 1 further comprising a means for gathering said top end whereby said top end can be gathered into a closed position whereby said opening in said front side becomes the only opening into an interior cavity within said body of insulating material.

5. The bag of claim 4 wherein said means for gathering comprises a drawstring located in the top end of the body and wherein upon gathering said top end, portions of said front side along two spaced sides of said opening are drawn into contact at a top end of said opening.

6. The bag of claim 1 wherein said panel member is fashioned from an insulating material.

7. The bag of claim 1 wherein said first and second connector means comprise complementary sides of a zipper.

8. The bag of claim 1 wherein said third and fourth connector means comprise complementary sides of a zipper.

9. The bag of claim 1 wherein said panel member includes a gathering means located on a top end thereof whereby when said panel member is attached to said front side of said body, gathering said top end of said panel using said gathering means causes a bottom portion of said hood opening adjacent said panel member to become smaller.

10. The bag of claim 9 wherein said hood means comprises a gathering means located on a front portion thereof about the periphery of its slot shaped opening for reducing the size of said opening.

11. A sleeping bag comprising:

a shell of insulating material having a bottom end, a top end, a top side and a bottom side;

said first and second sides including a connector means located on an edge portion of each of said sides for joining said sides together to thereby from a tube-like housing wherein said housing comprises an inner cavity and an exterior formed of said insulating material;

wherein said top side comprises a top portion having an opening therein, said opening being sized to expose a child's face when a child is within said cavity; and a gathering means located on a top portion of said bottom side whereby gathering said top portion of said bottom side causes two initially spaced top portions of said top side to become substantially in contact with each other.

12. An improved type of sleeping bag, said sleeping bag comprising a tubular body made from an insulating material, a cavity within said body and a closed bottom end, the improvement comprising:

an opening on at top portion of said body whereby a person can lay within said bag and have his or her face located in said opening and thereby be completely exposed to the environment exterior to the sleeping bag;

a panel member sized to completely cover said opening and means for attaching said panel member to said body about said opening; and a hood member and means for attaching said hood member to said body whereby the addition of said hood member and said panel member to said sleeping bag body allows the sleeping bag to comfortably house in mummy fashion a person that is longer than could be comfortably housed in mummy fashion within said sleeping bag prior to the addition of said panel member and hood member.

13. The sleeping bag of claim 12 wherein said tubular body further comprises a connecting means located on a side portion thereof for releasably connecting a top portion of said body to a bottom portion of said body.

14. A sleeping bag comprising:

a shell of insulating material having a bottom end, a top end, a top side and a bottom side;

said first and second sides including a connector means located on an edge portion of each of said sides for joining said sides together to thereby form a tube like housing wherein said housing comprises an inner cavity and an exterior formed of said insulating material;

an opening located in a top portion of said top side, said opening being sized to expose a child's face when a child is within said cavity;

a panel member sized to cover said opening in said top side;

connector means located on a peripheral edge of said panel member for connecting said panel member to a complementary connecting means located adjacent said top side opening;

a hood means having a front opening and bottom edge; and connector means located on said bottom edge of said hood means for connecting said hood means to a complementary connecting means located on a top end of said bottom side;

whereby a child of a first predetermined size can comfortably fit within said sleeping bag with the child's face located in said top side opening and, when said child grows to a length whereby the child can no longer comfortably fit within said bag, the panel member can be attached over said top side opening and the hood means can be attached to said bottom side and thereby extend the length of said sleeping bag to comfortably fit a child of a second predetermined length.

15. The sleeping bag of claim 14 further comprising a gathering means located in a top portion of said panel member capable of reducing a length dimension of said top portion of said panel member.

16. The sleeping bag of claim 14, wherein at least one of said connecting means is a zipper.

* * * * *